US008545338B2

(12) United States Patent
Cho

(10) Patent No.: US 8,545,338 B2
(45) Date of Patent: Oct. 1, 2013

(54) AUTOMATIC GOLF BALL SUPPLY DEVICE

(76) Inventor: Wan je Cho, Busan (KR)

( * ) Notice: Subject to any disclaimer, the term of this patent is extended or adjusted under 35 U.S.C. 154(b) by 208 days.

(21) Appl. No.: 13/000,360

(22) PCT Filed: May 28, 2009

(86) PCT No.: PCT/KR2009/002851

§ 371 (c)(1),
(2), (4) Date: Dec. 20, 2010

(87) PCT Pub. No.: WO2009/154364

PCT Pub. Date: Dec. 23, 2009

(65) Prior Publication Data

US 2011/0092302 A1 Apr. 21, 2011

(30) Foreign Application Priority Data

Jun. 19, 2008 (KR) ..... 10-2008-0057955

(51) Int. Cl.
*A63B 69/36* (2006.01)

(52) U.S. Cl.
USPC ..... 473/134; 473/136

(58) Field of Classification Search
USPC ..... 473/132–137
See application file for complete search history.

(56) References Cited

U.S. PATENT DOCUMENTS

| | | | | |
|---|---|---|---|---|
| 1,598,971 | A * | 9/1926 | Kenyon | 473/137 |
| 1,952,113 | A * | 3/1934 | Beckett | 473/137 |
| 2,127,282 | A * | 8/1938 | Beckett | 473/137 |
| 2,711,321 | A * | 6/1955 | McGraw, Sr. | 473/137 |
| 3,294,402 | A * | 12/1966 | Scott | 473/136 |
| 3,423,097 | A * | 1/1969 | Fry | 473/136 |
| 3,519,275 | A * | 7/1970 | Meierjohan | 473/136 |
| 3,778,067 | A * | 12/1973 | Gentiluomo | 473/133 |
| 3,966,213 | A * | 6/1976 | Bradley | 473/136 |
| 4,017,087 | A * | 4/1977 | Bruno | 473/133 |
| 4,146,232 | A * | 3/1979 | Stone | 473/137 |
| 5,078,401 | A * | 1/1992 | Fehrenbach et al. | 473/133 |

(Continued)

FOREIGN PATENT DOCUMENTS

| | | |
|---|---|---|
| CN | 2887358 | 4/2007 |
| KR | 200418251 | 6/2006 |
| KR | 200432332 | 12/2006 |

OTHER PUBLICATIONS

International Search Report for PCT/KR2009/002851 mailed on Dec. 3, 2009.

(Continued)

*Primary Examiner* — Steven Wong
(74) *Attorney, Agent, or Firm* — Christopher Paul Mitchell

(57) ABSTRACT

The present invention comprises: a frame; an ascending and descending vertical carrier; a motor; a first rod for performing a forwards rotation or backwards rotation movement; a second rod linked in movement to the other end of the first rod; a separating type of pressed-member which separates from the ascending and descending vertical carrier when the ascending and descending vertical carrier is ascending, and which collides with and is pressed by a pushing plate formed in the other side surface of the ascending and descending vertical carrier when the ascending and descending vertical carrier is descending; a rotational force transmission means for converting the pressing force of the pressed-member into a rotational force; and a golf ball guide member means for nudging the golf ball and settling it on a tee member of the ascending and descending vertical carrier when the vertical carrier has descended.

4 Claims, 16 Drawing Sheets

(56) References Cited

U.S. PATENT DOCUMENTS

| | | | | |
|---|---|---|---|---|
| 5,549,517 | A * | 8/1996 | Ikemoto | 473/134 |
| 5,718,638 | A * | 2/1998 | Kameda | 473/134 |
| 6,375,580 | B1 | 4/2002 | Schmidt et al. | |

OTHER PUBLICATIONS

Written Opinion of the International Searching Authority for PCT/KR2009/002851.

International Preliminary Report on Patentability for PCT/KR2009/002851.

* cited by examiner

[Fig. 1]
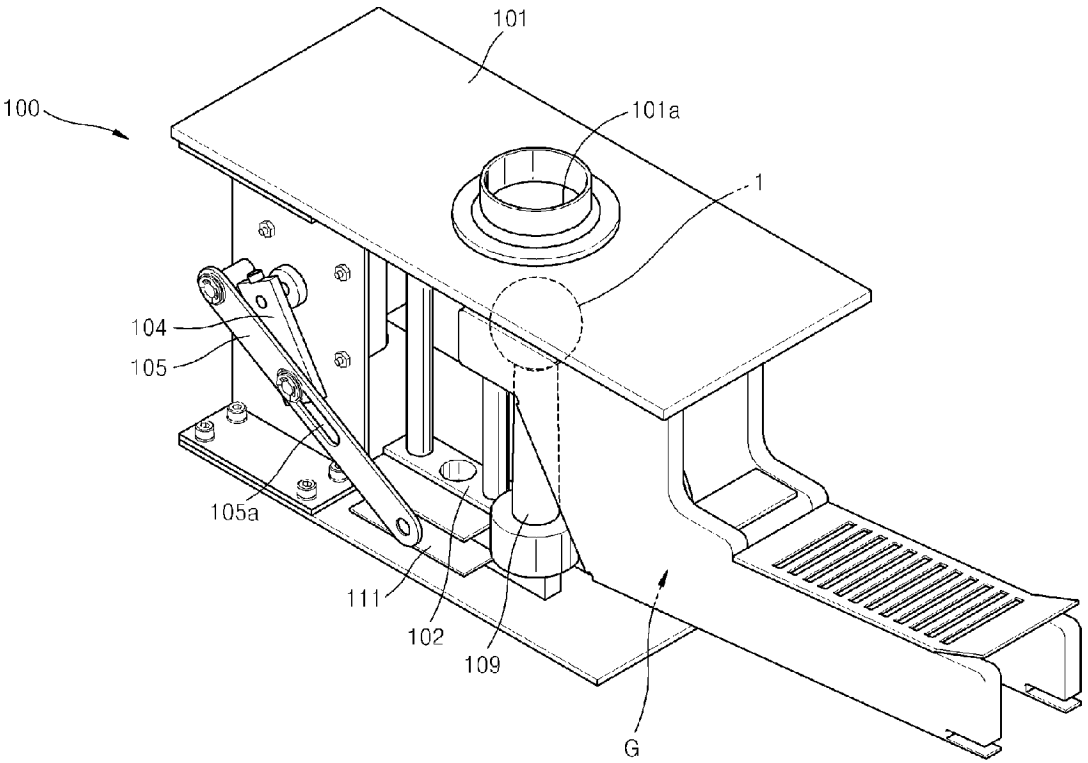

[Fig. 2]
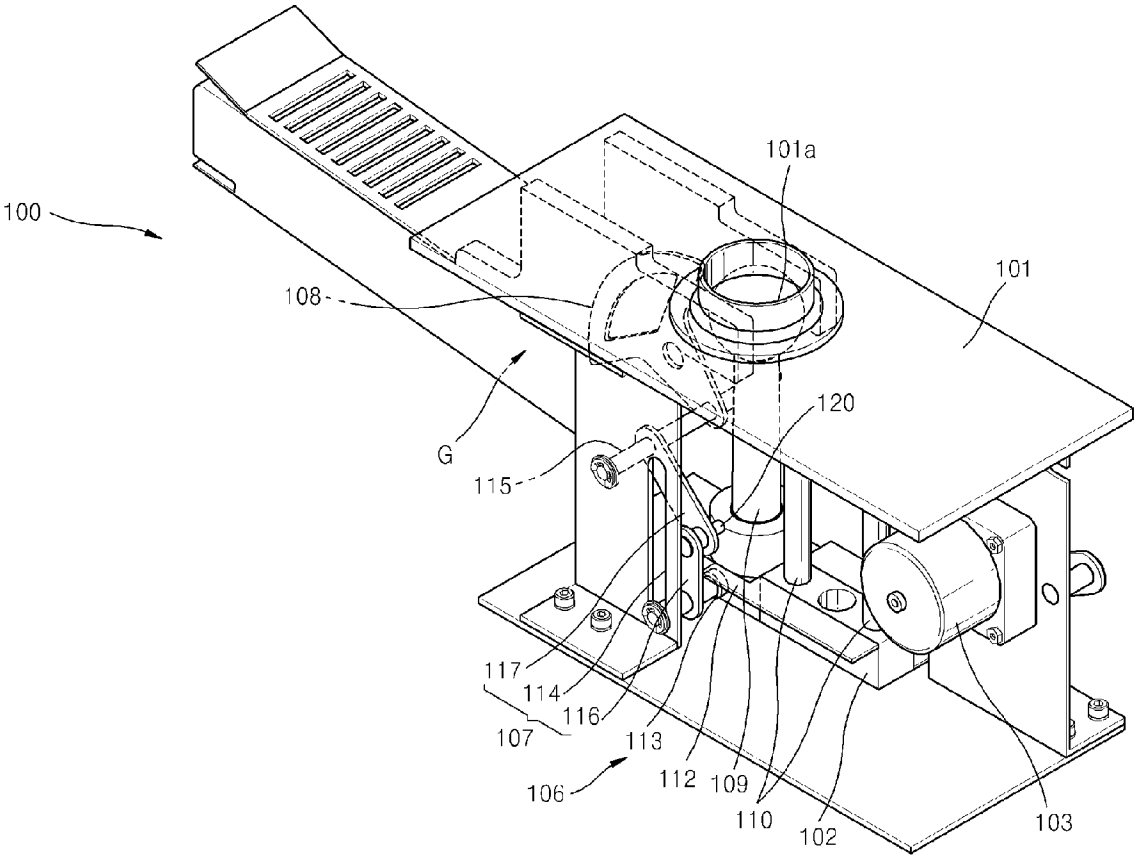

[Fig. 3]
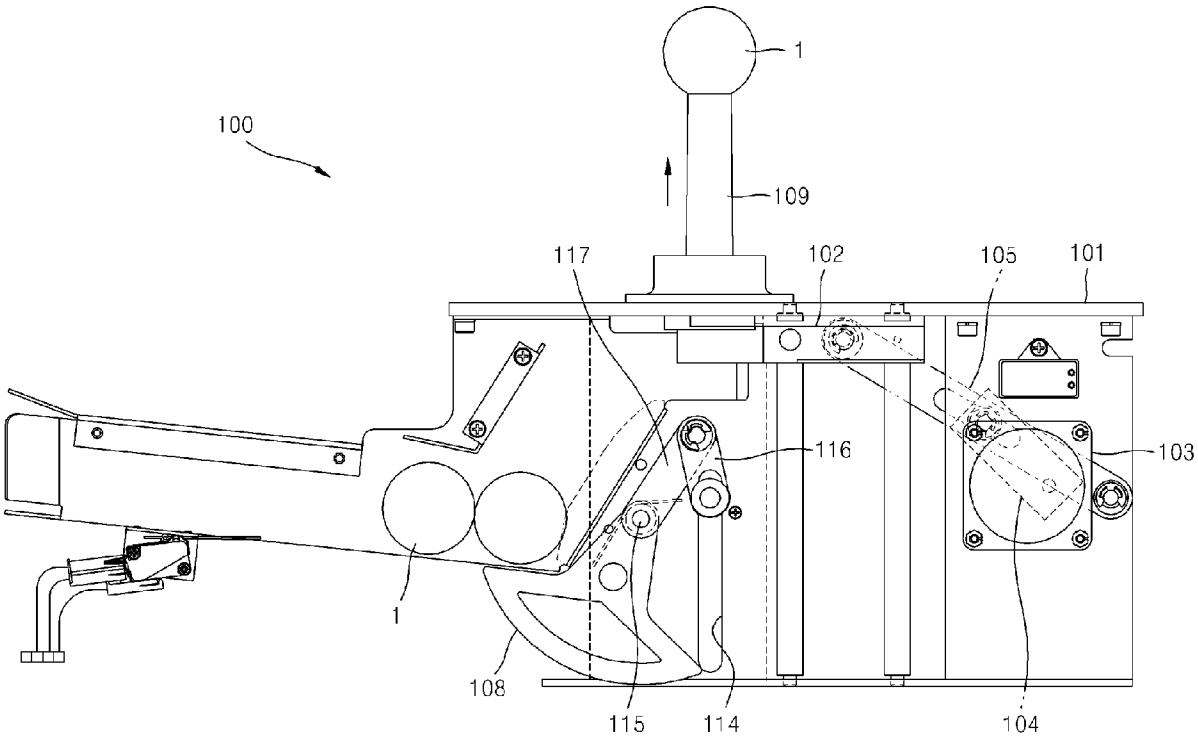

[Fig. 4]
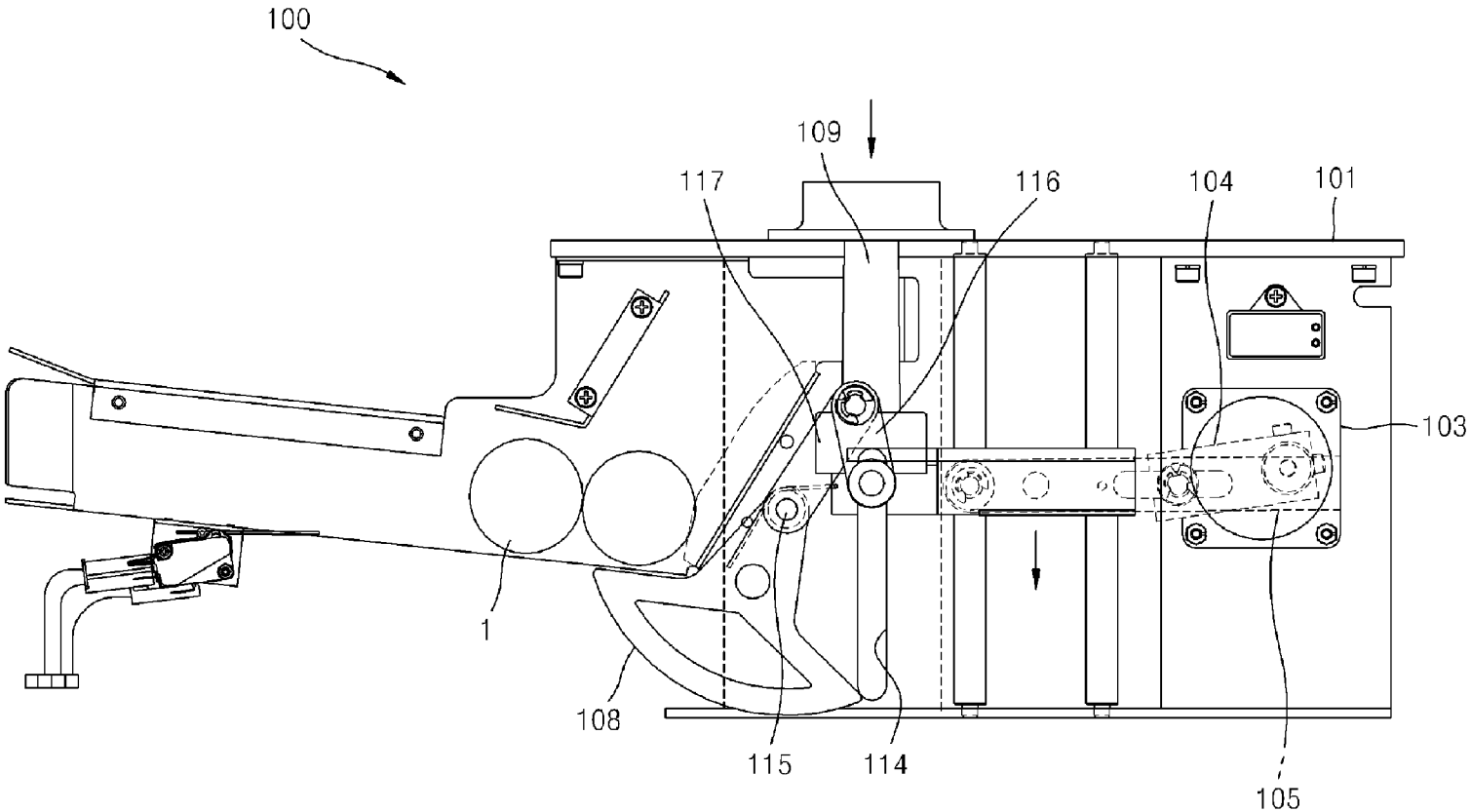

[Fig. 5]
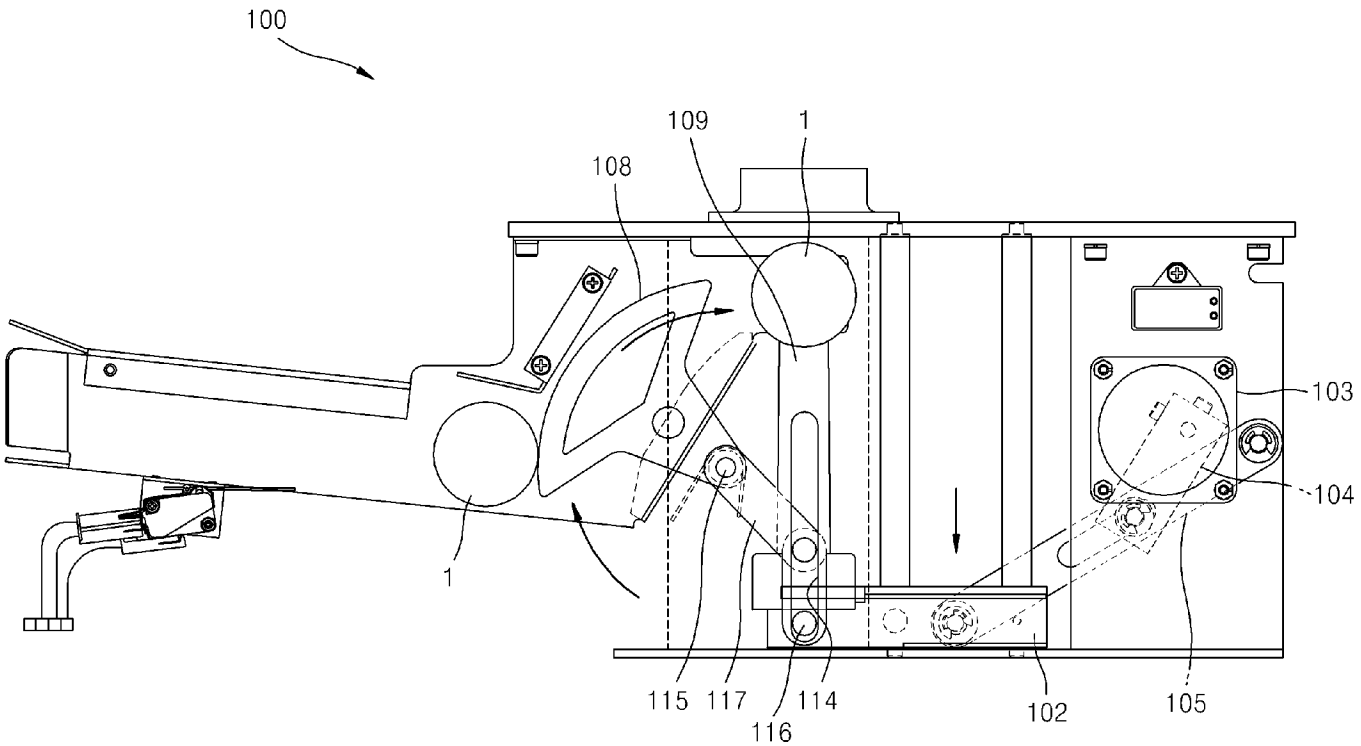

[Fig. 6]
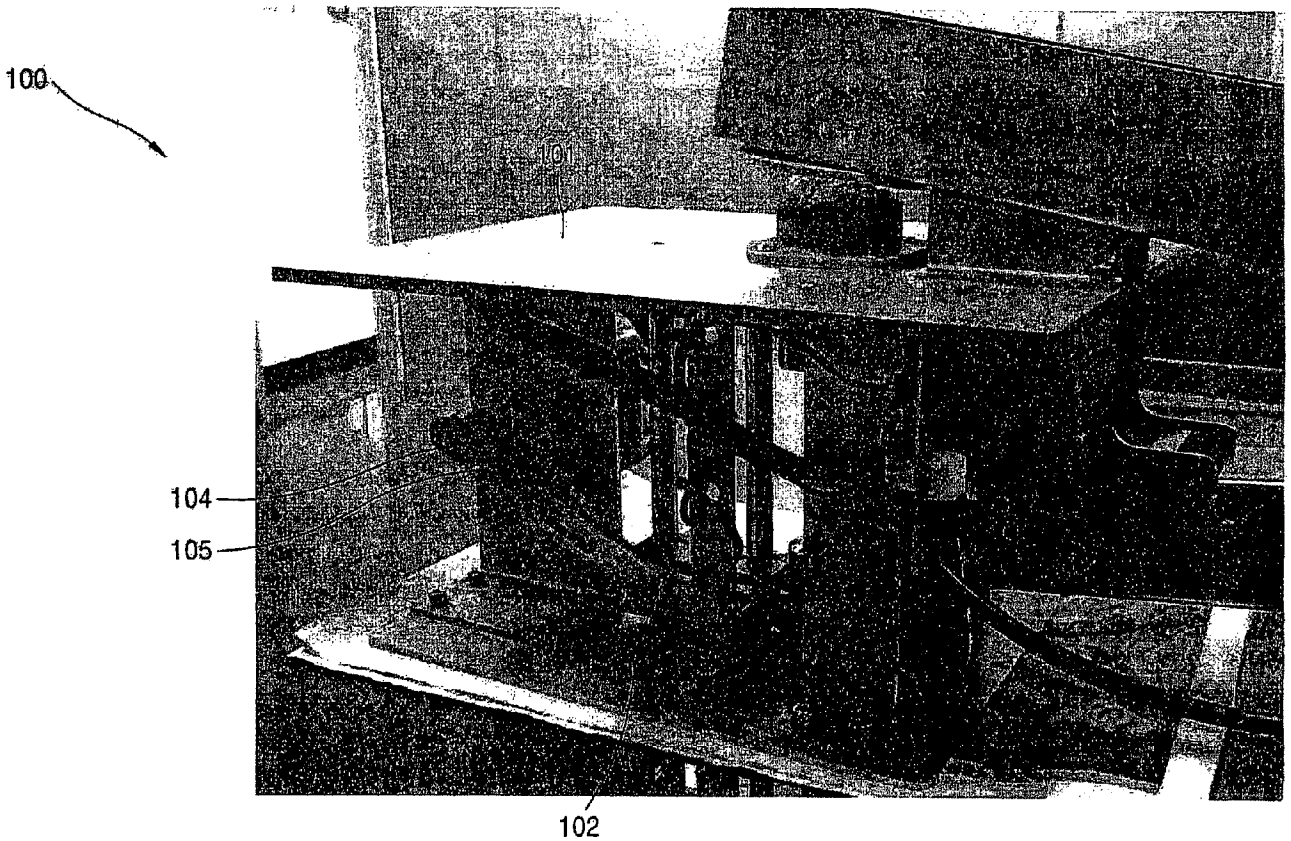

[Fig. 7]
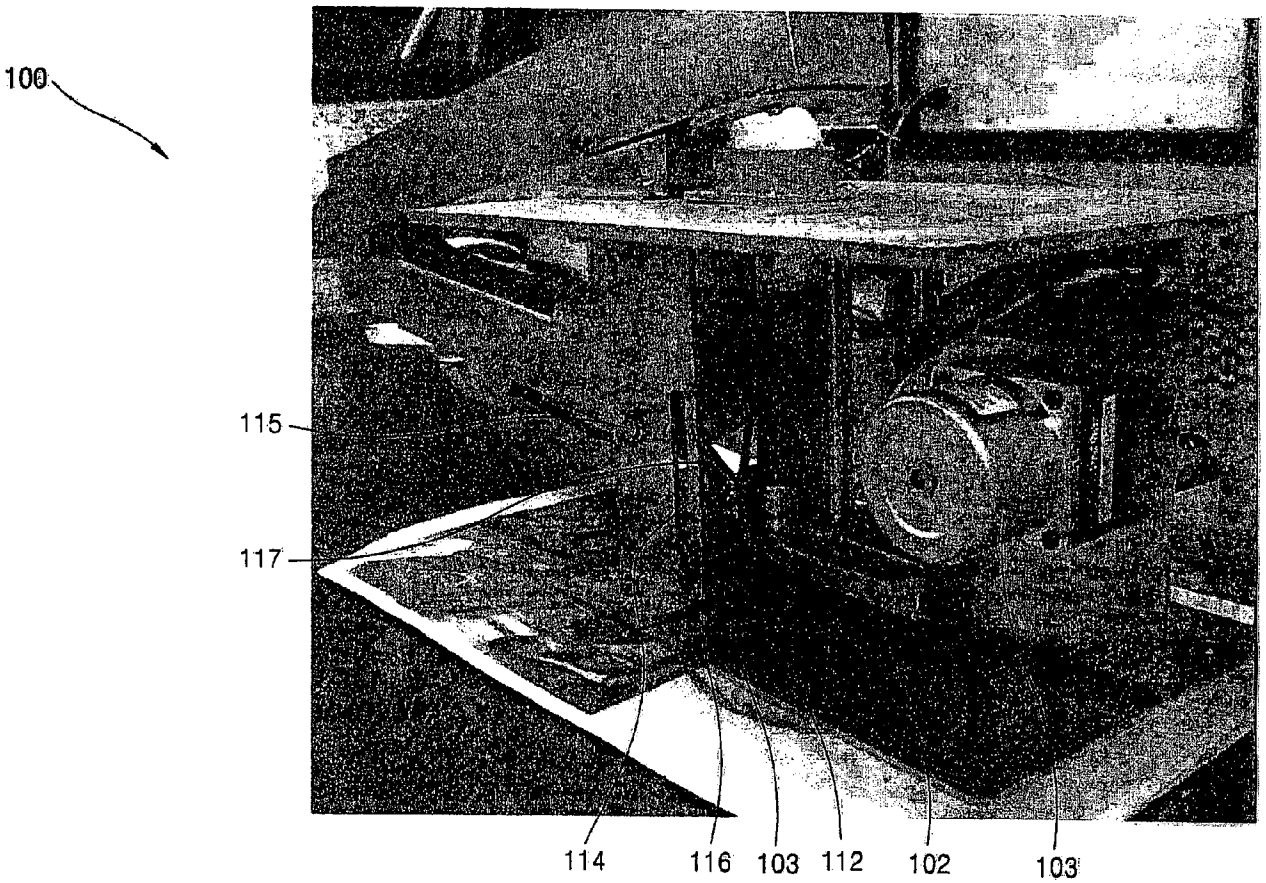

[Fig. 8]
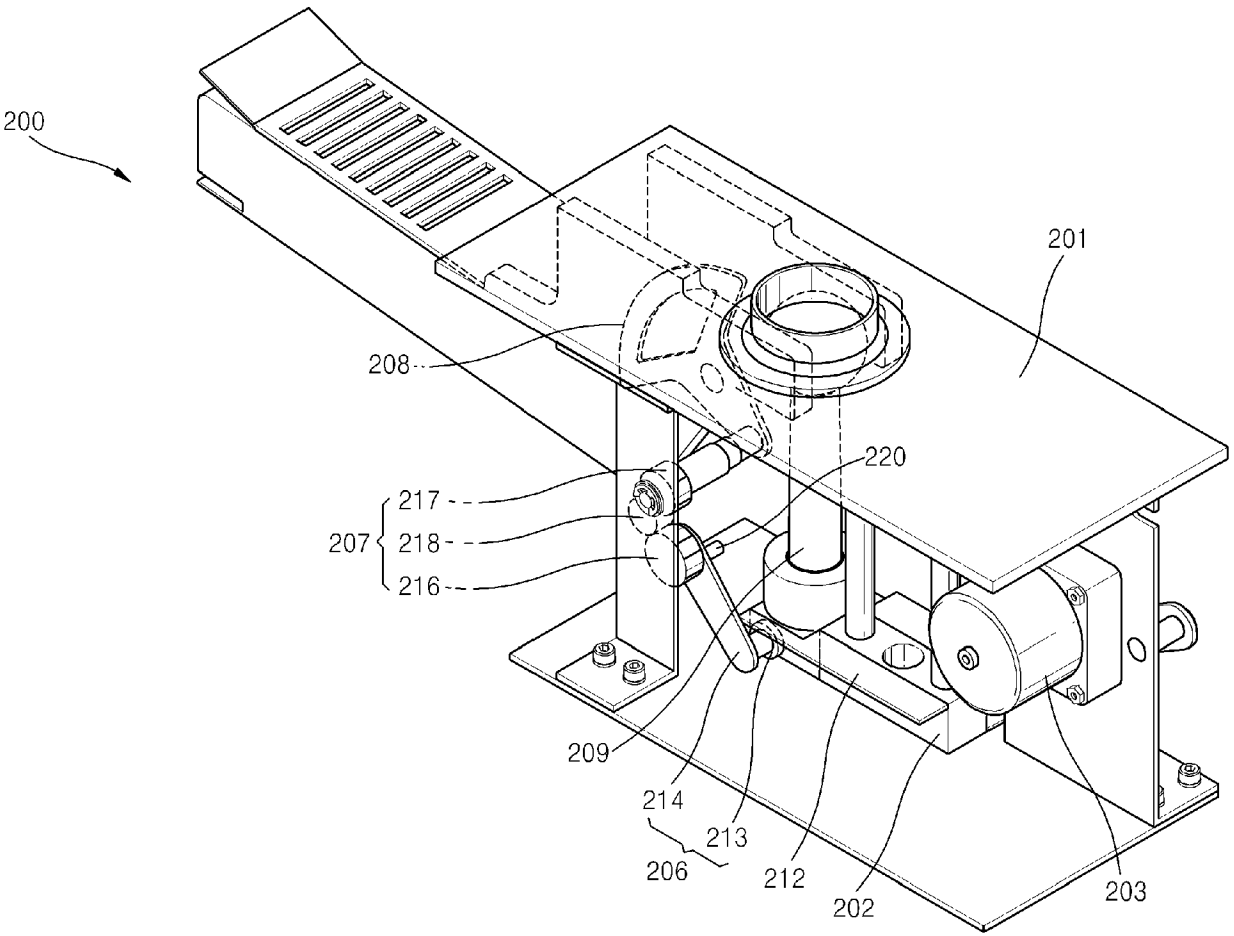

[Fig. 9]
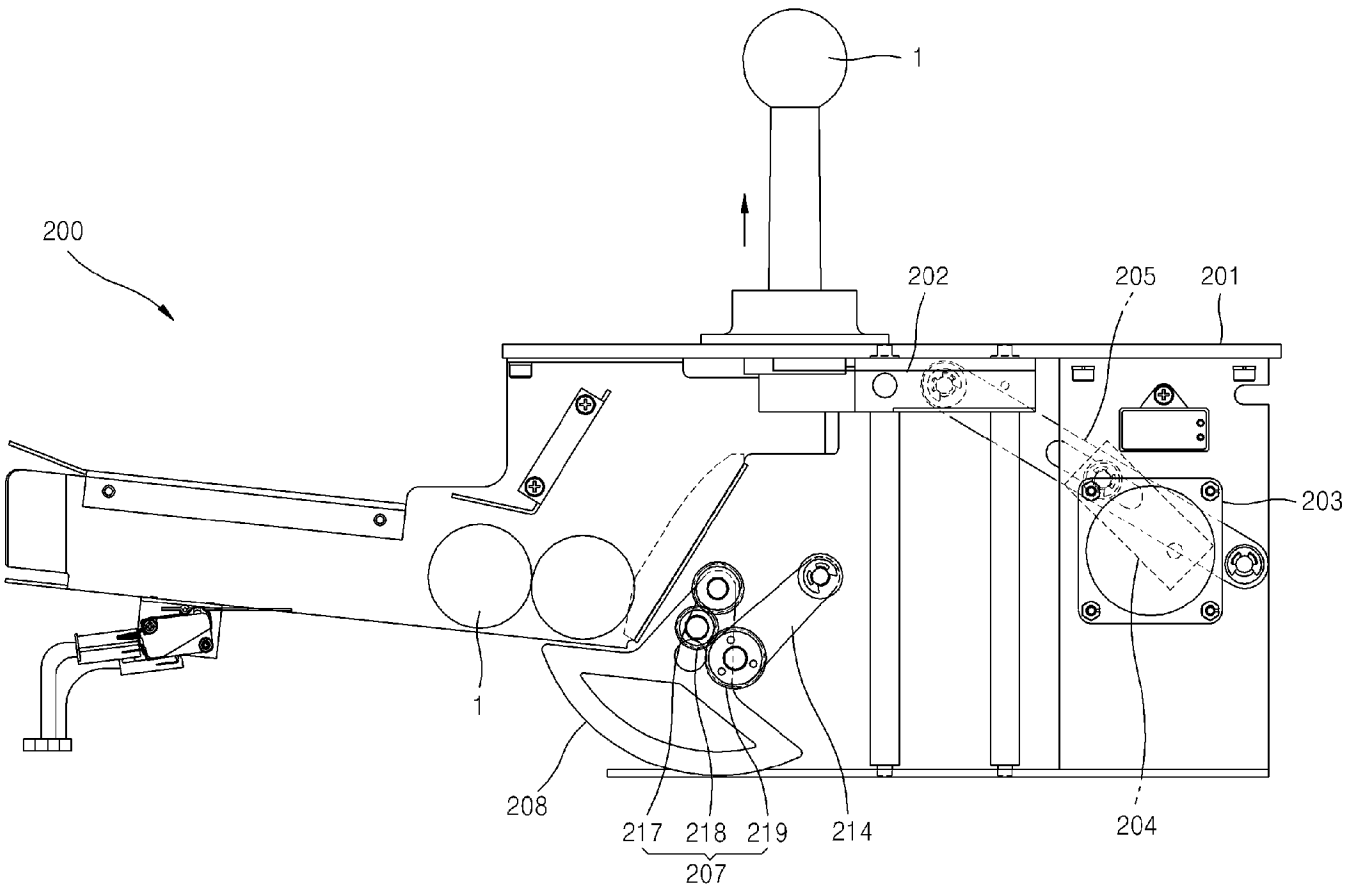

[Fig. 10]
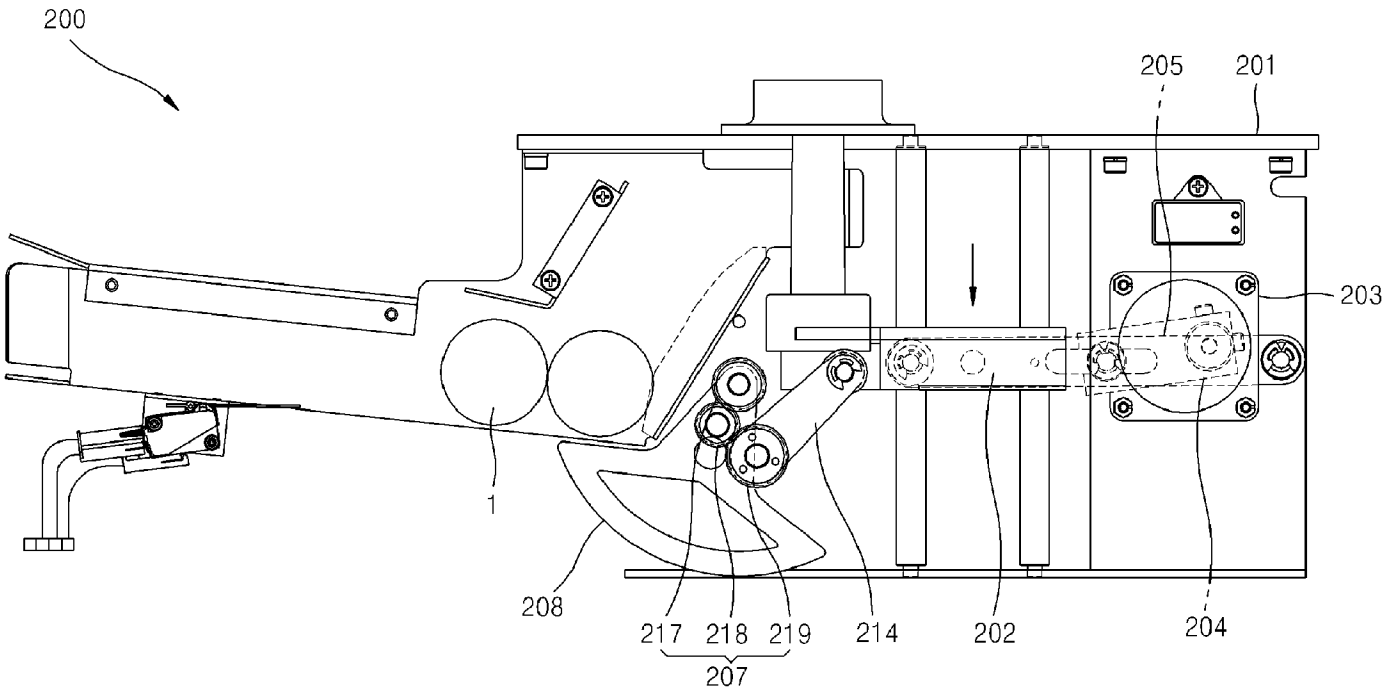

[Fig. 11]
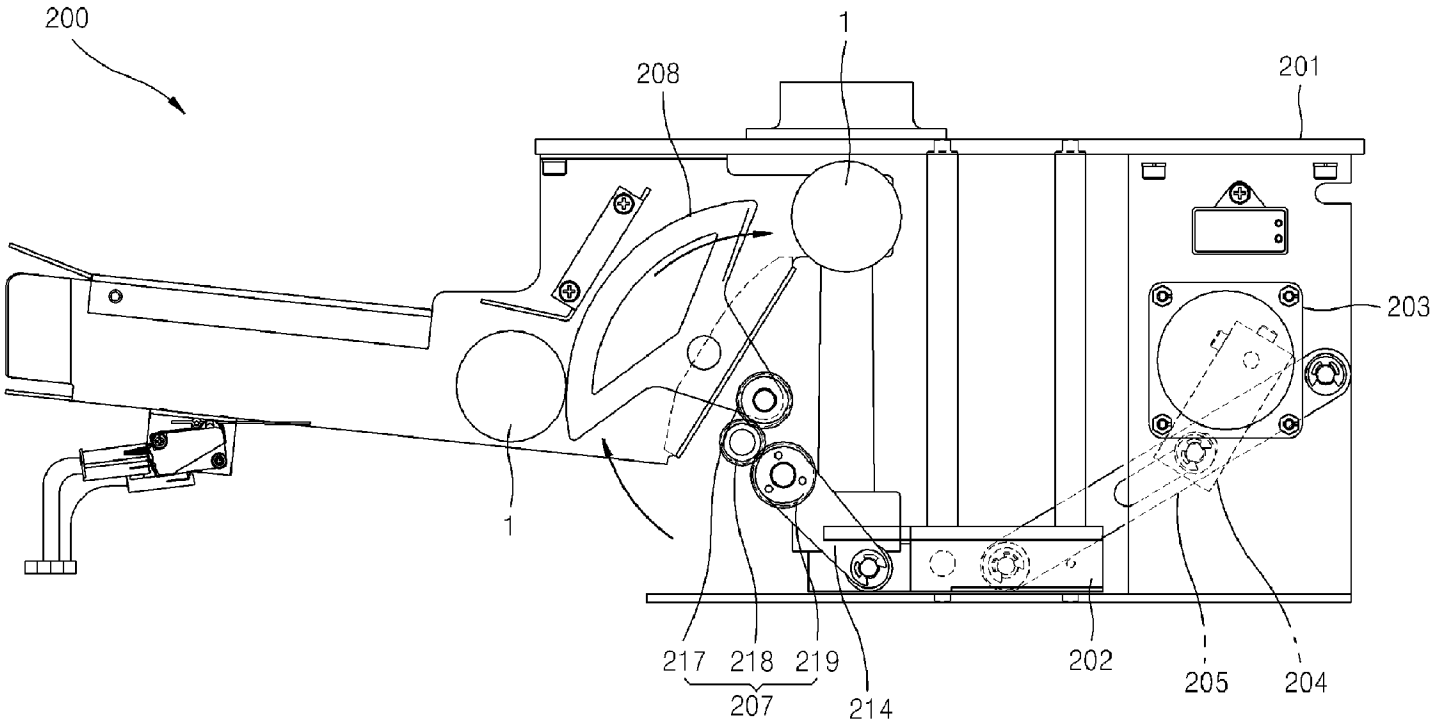

[Fig. 12]
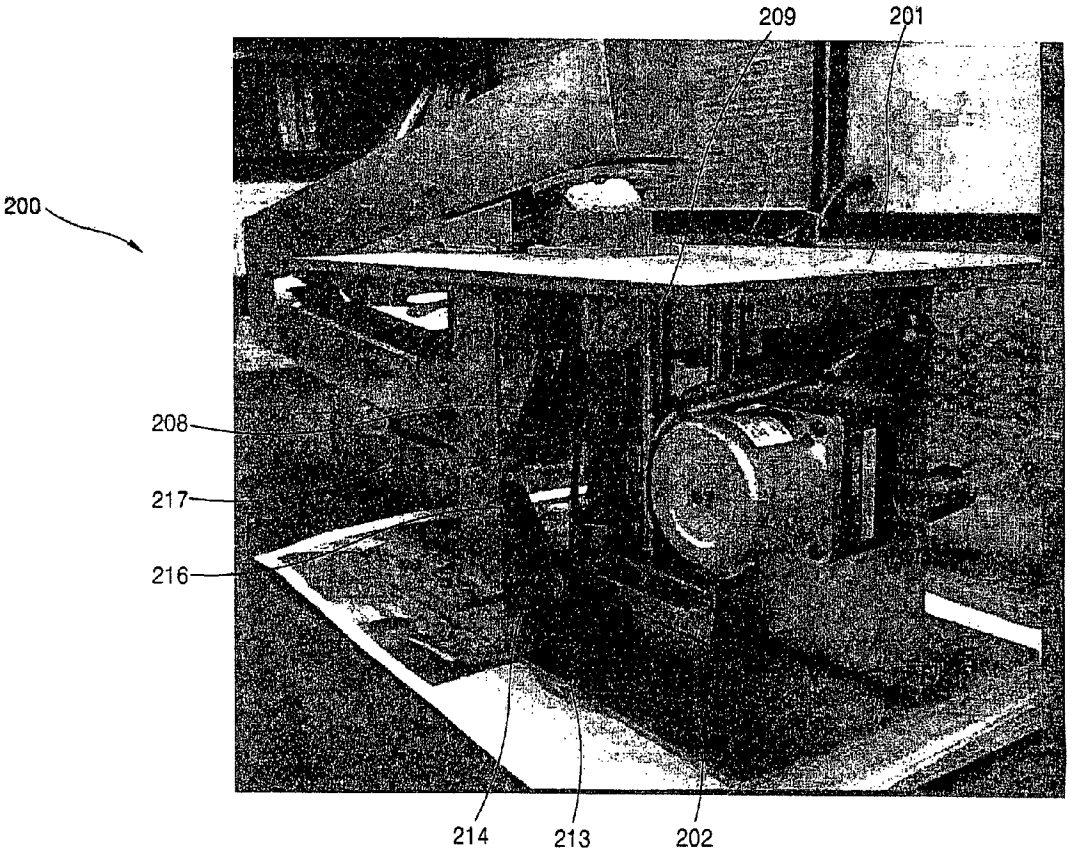

[Fig. 13]
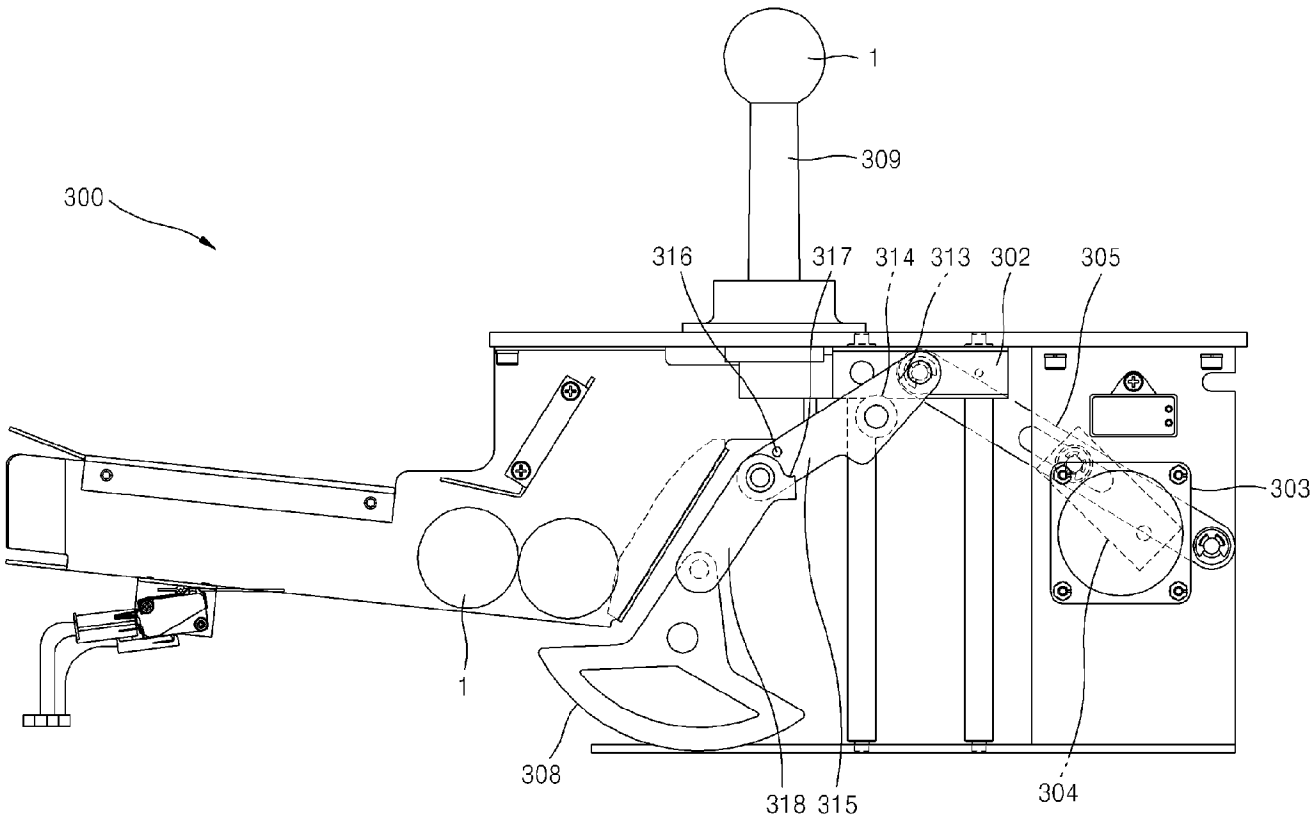

[Fig. 14]
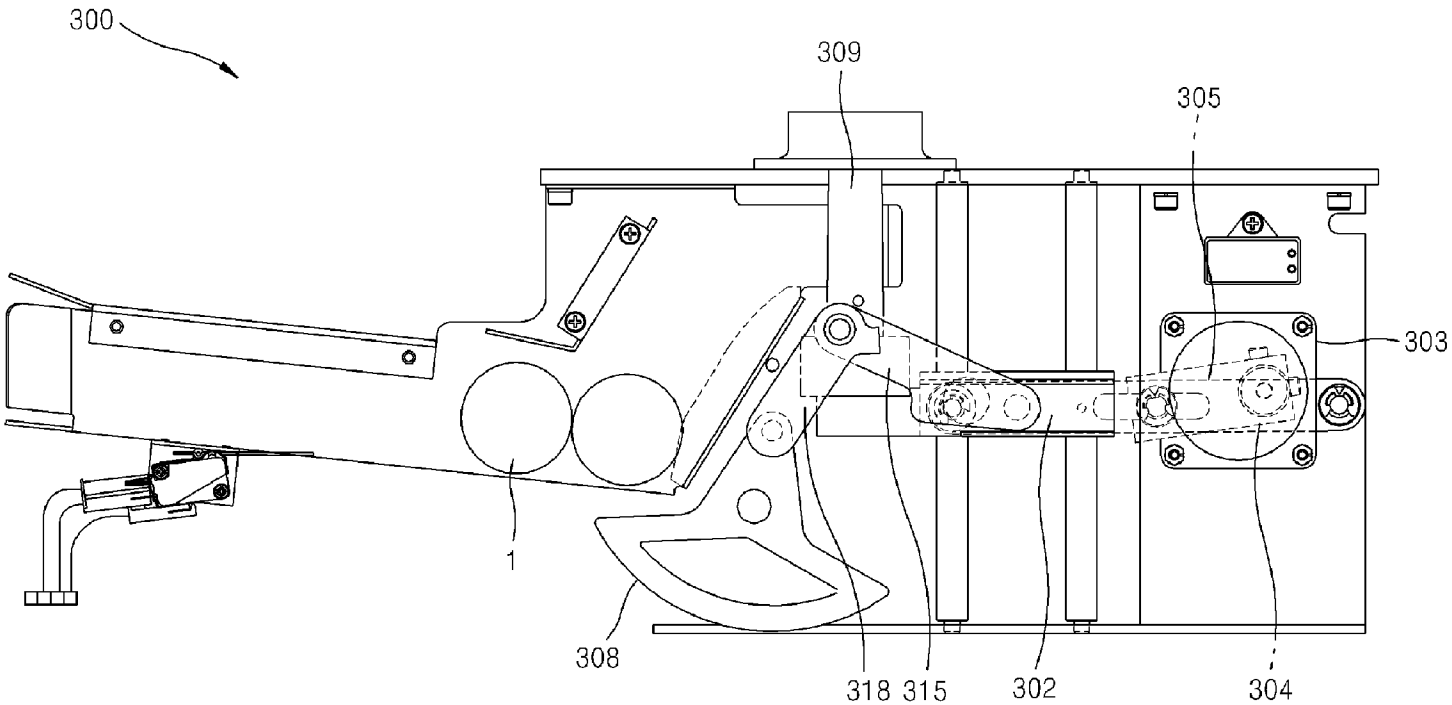

[Fig. 15]
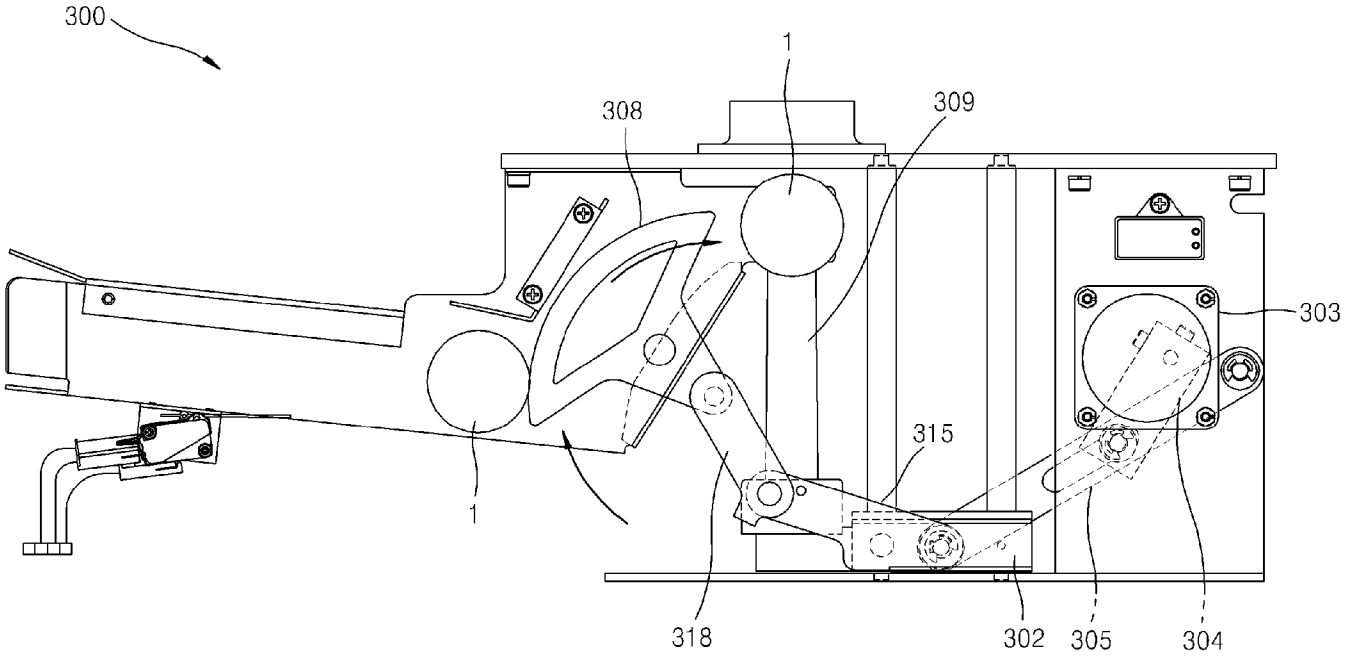

[Fig. 16]
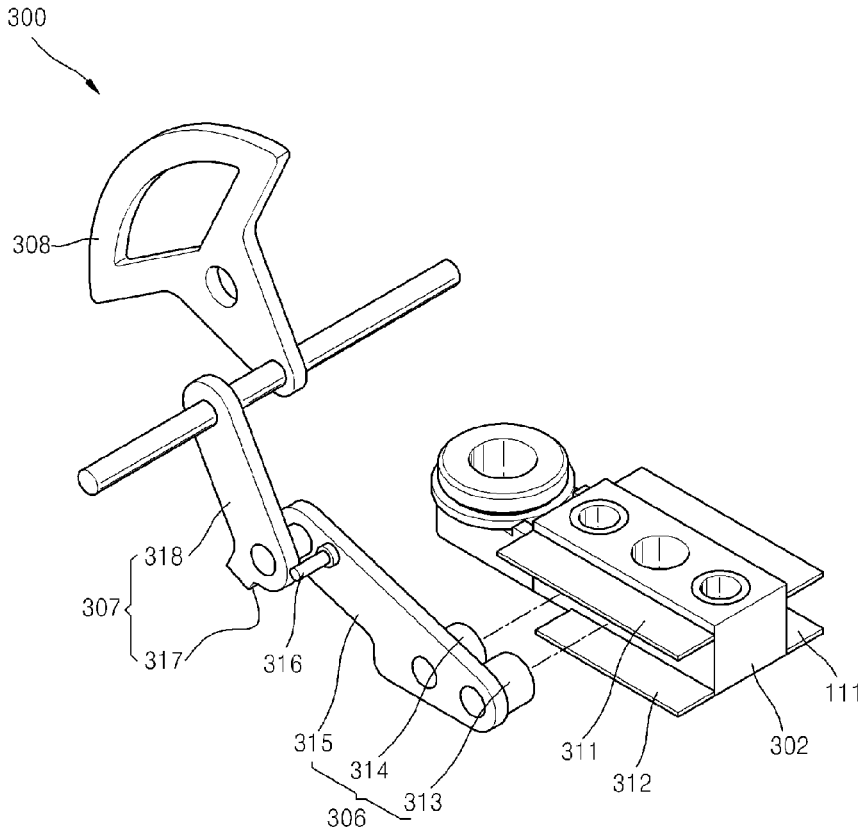

AUTOMATIC GOLF BALL SUPPLY DEVICE

RELATED APPLICATIONS

This application is a 371 application of International Application No. PCT/KR2009/002851, filed May 28, 2009, which in turn claims priority from Korean Patent Application No. 10-2008-0057955, filed Jun. 19, 2008, each of which is incorporated herein by reference in its entirety.

BACKGROUND OF THE INVENTION

1. Field of the Invention

The present invention relates to an automatic golf ball supply device, in more detail, an automatic golf ball supply device that can automatically and sequentially supply a plurality of golf balls to where a user hits the golf balls, for example in a golf practice range, and has a small malfunction rate and maintains smooth operation under various environment, with reduced manufacturing cost.

2. Description of the Related Art

In general, golf, sports in which the players hit a small round ball into desired holes, using as few hits as possible, is an event that is popular with a wide class.

It is very important to practice techniques for hitting a golf ball to a desired location in a desired direction in order to enjoy golf and it is general to practice in indoor and outdoor golf practice ranges before going to the field or in order to practice the golf techniques.

The devices automatically supplying golf balls to users in the golf practice range are the automatic golf ball supply devices, which are also called tee-up systems.

That is, the automatic golf ball supply devices of the related art are automatically supplied with golf balls from under the ground and automatically put the golf balls on a tee member, such as a tube-shaped elastic member, on the ground, without making the users directly put the golf balls on the tee (a rod stick in the ground to hold a golf ball at a predetermined height from the ground) with a hand.

Therefore, the users can continues practicing while sequentially receiving new golf balls after hitting the golf ball that has been supplied from the automatic golf ball supply device.

However, the automatic golf bass supply devices described above, as disclosed in Korean Patent Registration No. 353165, moves up a vertical carrier with a belt or pulleys and a golf ball guide member for putting on a golf ball on the vertical carrier; however, it has a problem that, first, the internal parts (e.g. the belt revolved by the pulleys) moves a long distance and the motor should continue operating while the parts move the long distance, such that large noise and vibration are caused.

Second, there was a problem in the automatic golf ball supply devices of the related art that the golf ball guide member putting a golf ball on the tee member moves at the same speed due to the constant movement of the belt etc., such that the golf ball fails to be flipped on the tee member and returns without being stably held on the tee member, when being put on the tee member, which is repeated.

Third, there was a problem in the automatic golf ball supply devices of the related art that the golf ball guide member always operates with the motor from the top dead center to the bottom dead center of the vertical carrier, such that the motor continues consuming power due to unnecessary operation of the golf ball guide member when the user accurately adjusts the height of the golf by operating a switch box after teeing up a golf ball and the golf ball guide member hits against the next golf ball while operating during the adjustment of the tee height, such that noise and vibration are additionally caused.

Fourth, there was a problem in the automatic golf ball supply devices of the related art that the height of a frame relatively increases due to the long movement distance of the belt, which causes a problem, such as a limit in installing the device in a golf practice range or the design of a golf practicing range.

In order to solve the problems of the related art, an automatic golf ball supply device has been developed which includes a vertical carrier freely moving up/down and stably put a golf ball on a tee, using the torque of a motor moving the vertical carrier up/down, for example, in Korean Utility Model Registration No. 200391702 and Korean Utility Model Registration No. 200418251.

However, the automatic golf ball supply device has an integrated-coupled structure in which parts, various rods, are hinged, linked, or firmly connected in a cam structure and the integrated-coupled structure has a problem that, first, the parts, particularly the parts connected with a vertical carrier are dependant on the up-down movement of the vertical carrier and moved with the vertical carrier, such that the parts rub with each other, and accordingly, the parts are easily worn or large noise and vibration are generated.

Second, there was a problem in the integrated-coupled structure that since the parts operate together with each other, foreign substances (soil particles, grass, and weeds etc.) are stuck in between the parts and interfere with the operation and a variety of malfunction or breakage of the parts may be caused when the operation with the foreign substances stuck is repeated.

Third, there was a problem in the integrated-coupled structure in that since the parts are firmly coupled, it is required to disassemble all the parts in order to replace of fix the parts.

Fourth, there was a problem in the integrated-coupled structure that it is trouble to assemble the parts and a too large number of parts are used, such that productivity reduces and manufacturing cost of the product increases.

SUMMARY OF THE INVENTION

In order to solve the problems described above, it is an object of the present invention to provide an automatic golf ball supply device that has a small volume, can improve durability of parts and prevent noise and vibration by reducing friction or collision between the parts, using a separable pressed-member separated from a vertical carrier, can be little influenced by various foreign substances (soil particles, grass, and weeds etc.) by separating the parts, can maintain a smooth operation under bad weather conditions, can make it easy to replace or fix the parts, can improve productivity, and can make it possible to reduce the manufacturing cost of the product.

In order to achieve the object of the present invention, the present invention provides an automatic golf ball supply device that automatically supplies golf balls to where a user hits the golf balls with a golf club. The automatic golf ball supply device includes: a frame having a golf ball outlet at the top; a carrier having a tee member where the golf ball is held and freely moving up/down to/from the outlet along a guide mounted on the frame; a motor mounted on the frame; a first rod having one end connected to a rotary shaft of the motor to pivot forward/backward; a second rod having a slit at the center portion where the other end of the first rod is fitted, one end hinged to the frame to be pivoted by the first rod, and the other end horizontally moving along a rail formed on one side of the vertical carrier; a separable pressed-member separated from the vertical carrier when the vertical carrier moves up, and hitting against a pressing plate formed on the other side of the vertical carrier to be pressed when the vertical carrier moves down; a torque transmitting member connected to the pressed-member and converting the force pressing the pressed-member into torque; and a golf ball guide member pushing the golf ball in the golf ball reservation room to be held on the tee member of the vertical carrier, which has moved down, while being pivoted by the torque transmitting member.

Further, according to the present invention, the separable pressed-member may include an elastic roller that hits against the pressing plate of the vertical carrier, and the torque transmitting member may include a link having one end that is guided up/down by a vertical slit formed at the frame and the other end linked with a protruding arm positioned on the same axis with the golf ball guide member.

Further, according to the present invention, the separable pressed-member may include a rotary member having one end hinged to the frame and the other end equipped with an elastic roller that hits against with the pressing plate of the vertical carrier, and the torque transmitting member may include a driving gear coupled to one end of the rotary lever, a driven gear coupled to a rotary shaft of the golf ball guide member, and an intermediate gear disposed between the driving gear and the driven gear.

Further, according to the present invention, the separable pressed-member may include a pressed-link having a first roller and a second roller that are fitted inside a second rail of the vertical carrier while hitting against the pressing plate of the vertical carrier, and the torque transmitting member may include a protruding hinge arm having one end hinged to the other end of the pressed-link, a locking protrusion that is locked to a preliminary rotary stopper formed at one side of the pressed-link, and the other end positioned on the same rotary axis with the golf ball guide member.

As described above, according to the automatic golf ball supply device of the present invention, it is possible to reduce a malfunction rate, maintain a smooth operation under various environments, improve durability, prevent noise and vibration, reduce bad influence due toe various foreign substances, easily replace or fix the parts, improve productivity, and reduce the manufacturing cost of the product.

BRIEF DESCRIPTION OF THE DRAWINGS

FIG. 1 is a front perspective view showing an automatic golf ball supply device according to a preferred embodiment of the present invention.

FIG. 2 is a rear perspective view of FIG. 1.

FIGS. 3 to 5 are views sequentially showing the operation of the automatic golf ball supply device of FIG. 1.

FIG. 6 is a picture of the front of the automatic golf ball supply device of FIG. 1.

FIG. 7 is a picture of the rear of the automatic golf ball supply device of FIG. 2.

FIG. 8 is a rear perspective view showing an automatic golf ball supply device according to another preferred embodiment of the present invention.

FIGS. 9 to 11 are views sequentially showing the operation of the automatic golf ball supply device of FIG. 8.

FIG. 12 is a picture of the rear of the automatic golf ball supply device of FIG. 8.

FIGS. 13 to 15 are views sequentially showing the operation of an automatic golf ball supply device according to another preferred embodiment of the present invention.

FIG. 16 is a perspective assembly view showing the main parts of the automatic golf ball supply device of FIG. 13.

DETAILED DESCRIPTION OF THE PREFERRED EMBODIMENTS

Hereinafter, automatic golf ball supply devices according to preferred embodiments of the present invention are described in detail with reference to the accompanying drawings.

FIG. 1 is a front perspective view showing an automatic golf ball supply device 100 according to a preferred embodiment of the present invention, FIG. 2 is a rear perspective view of FIG. 1, FIGS. 3 to 5 are views sequentially showing the operation of the automatic golf ball supply device 100 of FIG. 1, FIG. 6 is a picture of the front of the automatic golf ball supply device 100 of FIG. 1, and FIG. 7 is a picture of the rear of the automatic golf ball supply device of FIG. 2.

First, as shown in FIGS. 1 and 2, an automatic golf ball supply device 100 according to a preferred embodiment of the present invention is an automatic golf ball supply device 100 automatically supplying golf balls 1 to where a user hits the golf balls 1 with a golf club, and includes a frame 101, a vertical carrier 102, a motor 103, a first rod 104, a second rod 105, a separable pressed-member 106, a torque transmitting member 107, and a golf ball guide member 108.

In this configuration, the frame 101, the metal framework of the automatic golf ball supply device 100, has a golf ball outlet 101*a* for discharging upward the golf ball 1, at the top.

Further, the vertical carrier 102 is mounted on the frame 101 and has an elastic tube-shaped tee member 109 where the golf ball 1 is held, at the top, and freely moves up/down from/to the outlet 101*a* along a guide 110 mounted on the frame 101.

In this configuration, the guide 110 may be composed of two guide bars standing inside the frame 101, as shown in FIGS. 1 and 2.

Further, the motor 103 is a driving device mounted on the frame 101 and pivoting forward/backward the first rod 104.

Though not shown in this configuration, the motor 103 is controlled by controls signals transmitted from a specific controller connected with a switch box.

Further, one end of the first rod 104 is connected to the rotary shaft of the motor 103 to pivot forward/backward.

Further, the second rod 105 operates with the first rod 104, has a slit 105*a* formed at the center portion to connect the other end of the first rod 104, one end hinged to the frame 101 and pivoted by the first rod 104, and a the other end horizontally moving along a rail 111 formed on one side of the vertical carrier 102.

Therefore, as the motor 103 rotates forward/backward, the first rod 104 connected to the rotary shaft of the motor 103 pivots forward/backward and the second rod 105 operating with the first rod 104 horizontally moves along the rail 111 of the vertical carrier 102, such that the torque of the motor 103 can be converted into vertical movement force of the vertical carrier 102.

Meanwhile, the automatic golf ball supply device 100 can make the golf ball guide member 108 put the golf ball 1 on the tee member 109 of the vertical carrier 102, using the vertical movement force of the vertical carrier 102.

That is, the separable pressed-member 106 is separated from the vertical carrier 102 when the vertical carrier 102 moves up, and is hit and pressed by a pressing plate 112 formed on the other side of the vertical carrier 102 when the vertical carrier 102 moves down, such that it can stand by in separation from the vertical carrier 102.

Therefore, when the separable pressed-member stands by in separation from the vertical carrier 102, it does not rub with the vertical carrier 102 and there is no gap for foreign substances to be stuck, such that the foreign substances are not stuck between the vertical carrier 102 and the separable pressed-member 106 or do not have a bad influence; therefore, it is possible to improve durability of the parts and prevent malfunction due to the foreign substances which frequently occurs under bad weather or the outdoor environment.

On the other hand, the torque transmitting member 107 is connected to the pressed-member 106 and converts the pressing force of the pressed-member 106 into torque, that is, it pivots the golf ball guide member 108, using the pressing force of the pressed-member 106 pressed by the vertical carrier 102.

In this configuration, the golf ball guide member 108 puts the golf ball 1 from a golf ball storage G onto the tee member of the vertical carrier 102 while being pivoted by the torque transmitting member 107 and an arc rotator that can lift up the golf ball 1 is shown in the drawings.

In particular, as an example of the automatic golf ball supply device of the present invention, as shown in FIGS. 1 to 7, the separable pressed-member 106 may be an elastic roller 113 that hits against the pressing plate 112 of the vertical carrier 102.

Further, the torque transmitting member 107 has one end that is guided along a vertical slit 114 of the frame 101 to be prevented from failing to contact with the pressing plate 112 due to external interference or shaking, and the other end with a link 116 that is linked with a protruding arm 117 positioned coaxially with the golf ball guide member 108 on the rotary shaft 115.

On the other hand, as shown in FIG. 2, a forcible returning protrusion 120 that interferes with the pressing plate 112 may be formed at one end of the protruding arm 117 such that the golf ball guide member 108 can be forcibly returned to the stand-by state, when the vertical carrier 102 moves up.

Therefore, in the operation of the automatic golf ball supply device 100 according to a preferred embodiment of the present invention, as shown in FIG. 3, the vertical carrier 102 and the elastic roller 113 are separated from each other when the vertical carrier 102 has moved up, in which the elastic roller 113 can keep standing by until the vertical carrier 102 starts moving down.

In this standing-by state, a user can adjust the tee height by moving up/down the vertical carrier 102 within a tee height adjustment range by operating the switch.

Thereafter, the user can hit the golf ball 1 held on the tee member 109 of the vertical carrier 102 with a golf club.

Further, as shown in FIG. 4, when a ball sensor (not shown) mounted to the tee member 109 detects that there is no ball, after the hitting, the motor 103 rotates forward, the vertical carrier 102 is moved down by the first rod 104 and the second rod 105, and the pressing plate 112 of the vertical carrier 102 hits against the elastic roller 113 while the vertical carrier 102 moves down along the guide 110 with the tee member 109 without a ball.

In this operation, since the elastic roller 113 is made of an elastic material, it can prevent bad influence from foreign substances due to a small contact area with the vertical carrier 102 while attenuating shock, noise, and vibration.

Further, as shown in FIG. 5, while the vertical carrier 102 continues moving down, the link 116 pressed by the pressing plate 112 of the vertical carrier 102 moves down along the vertical slit 114, the protruding arm 117 connected with the link 116 pivots with the downward movement of the link 116, and the golf ball guide member 108 pushes the golf ball 1, thereby the golf ball 1 can be held on the tee member 109.

Thereafter, when the process described above is reversed, as the motor 103 rotates backward, the vertical carrier 102 is moved up by the first rod 104 and the second rod 105 and the golf ball 1 is prepared to be hit.

FIG. 8 is a rear perspective view showing an automatic golf ball supply device 100 according to another preferred embodiment of the present invention, FIG. 9 is a rear perspective view of FIG. 8, FIGS. 10 to 12 are views sequentially showing the operation of the automatic golf ball supply device 100 of FIG. 8, FIG. 13 is a picture of the front of the automatic golf ball supply device 100 of FIG. 8, and FIG. 14 is a picture of the rear of the automatic golf ball supply device 100 of FIG. 9.

As shown in FIGS. 8 and 9, a rotary lever 214 having one end hinged to a frame 201 and the other end coupled with an elastic roller 213 that hits against a pressing plate 212 of a vertical carrier 202 may be used as a separable pressed-member 206, in an automatic golf ball supply device 200 according to another preferred embodiment of the present invention.

Further, a torque transmitting member 207 may be composed of a driving gear 216 coupled to one end of the rotary lever 214, a driven gear 217 coupled to the rotary shaft of a golf ball guide member 208, and an intermediate gear 218 disposed between the driving gear 216 and the driven gear 217.

On the other hand, as shown in FIG. 8, a forcible returning protrusion 220 that interferes with a pressing plate 212 may be formed at one end of the driving gear 216 such that the golf ball guide member 208 can be forcibly returned to the stand-by state, when the vertical carrier 202 moves up.

Therefore, in the operation of the automatic golf ball supply device 200 according to another preferred embodiment of the present invention, as shown in FIG. 10, the vertical carrier 202 and the elastic roller 213 are separated from each other when the vertical carrier 202 has moved up, in which the elastic roller 213 can keep standing by until the vertical carrier 202 starts moving down.

In this standing-by state, the user can adjust the tee height by moving up/down the vertical carrier 202 within a tee height adjustment range by operating the switch.

Thereafter, the user can hit the golf ball 1 held on a tee member 209 of the vertical carrier 202 with a golf club.

Further, as shown in FIG. 11, when a ball sensor (not shown) mounted to the tee member 209 detects that there is no ball, after the hitting, the motor 203 rotates forward, the vertical carrier 202 is moved down by a first rod 204 and a second rod 205, and the pressing plate 212 of the vertical carrier 202 hits against the elastic roller 213 while the vertical carrier 202 moves down along a guide 210 with the tee member 209 without a ball.

In this operation, since the elastic roller 213 is made of an elastic material, it can prevent bad influence from foreign substances due to a small contact area with the vertical carrier 202 while attenuating shock, noise, and vibration.

Further, as shown in FIG. 12, while the vertical carrier 202 continues moving down, the rotary lever 214 pressed by the pressing plate 212 of the vertical carrier 202 pivots forward with the driving gear 216, the intermediate gear 218 rotates backward with the forward rotation of the driving gear 216, and the driven gear 217 rotates forward with the backward rotation of the intermediate gear 218, such that the golf ball 1 can be put and held on the tee member 209 without a ball.

Thereafter, when the process described above is reversed, as the motor 203 rotates backward, the vertical carrier 202 is moved up by the first rod 204 and the second rod 205 and the golf ball 1 is prepared to be hit.

On the other hand, FIGS. 13 to 15 are views sequentially showing the operation of an automatic golf ball supply device 300 according to another preferred embodiment of the present invention and FIG. 16 is a perspective assembly view showing the main parts of the automatic golf ball supply device of FIG. 13.

As shown in FIG. 16, the automatic golf ball supply device 300 according to another preferred embodiment of the present invention may include a pressed-link 315 having a first roller 313 and a second roller 314 at one end, which are fitted inside a second rail 312 of a vertical carrier 302 while hitting against a pressing plate 311, for a separable pressed-member 306.

Further, it may include a protruding hinge arm 318 having one end hinged to the other end of the pressed-link 315, a locking protrusion 317 that is locked to a preliminary rotary stopper 316 formed at one side of the pressed-link 315, and the other end positioned a the same rotary axis with a golf ball guide member 308, for a torque transmitting member 307.

Therefore, in the operation of the automatic golf ball supply device according to another preferred embodiment of the present invention, as shown in FIG. 13 first, the vertical carrier 302, the first roller 313, and the second roller 314 are spaced apart from, only in contact with, or separated from each other, when the vertical carrier 302 has moved up, such that as the first roller 313 and the second roller 314 moves down, the stopper 316 hits against the locking protrusion 317 and keep standing by until the vertical carrier 302 starts moving down.

In this standing-by state, the user can adjust the tee height by moving up/down the vertical carrier 302 within a tee height adjustment range by operating the switch.

Thereafter, the user can hit the golf ball 1 held on a tee member 309 of the vertical carrier 302 with a golf club.

Further, as shown in FIG. 14, when a ball sensor (not shown) mounted to the tee member 309 detects that there is no ball, after the hitting, a motor 303 rotates forward, the vertical carrier 302 is moved down by a first rod 304 and a second rod 305, and the stopper 316 hits against the locking protrusion 317 first to reduce shock applied to the vertical carrier 302 and then hits against the pressing plate 311 while the vertical carrier 302 moves down with the tee member 309 along a guide 310 in the tee height adjustment range.

In this operation, since first roller 313 and the second roller 314 are made of an elastic material, they can prevent bad influence from foreign substances due to a small contact area with the vertical carrier 302 while attenuating shock, noise, and vibration.

Further, as shown in FIG. 15, while the vertical carrier 302 continues moving down, the pressed-link 315 pressed by the pressing plate 312 of the vertical carrier 302 pivots forward and the vertical carrier 302 continues moving down, with the second roller 314 hitting against the pressing plate 311 and stopping rotation, and accordingly, the protruding hinge arm 318 pivots backward and the golf ball guide member 308 pushes the golf ball 1, thereby the golf ball 1 can be held on the tee member 309.

Thereafter, when the process described above is reversed, as the motor 303 rotates backward, the vertical carrier 302 is moved up by the first rod 304 and the second rod 305 and the golf ball 1 is prepared to be hit.

Therefore, according to the embodiments of the present invention, it is possible to improved durability of the parts by reducing friction and collision between the parts, using separable pressed-members that are separated from the vertical carrier 302, and prevent noise and vibration. Further, since the parts are separated, it is possible to reduce bad influence due to various foreign substances (soil particles, grass, and weeds etc.).

Further, since the separable pressed-members are not coupled to the vertical carrier, it is possible to easily replace or fix desired parts, and accordingly, it is possible to improve productivity and reduce the manufacturing cost by optimizing the parts.

The present invention is not limited to the embodiments described above and may be modified by those skilled in the art, without departing from the scope of the present invention.

Therefore, it should be understood that the spirit of the present invention is not determined within the embodiments described above and limited by the scope described in the following claims.

According to the present invention, it is possible to improve durability of parts, prevent noise and vibration, reduce bad influence due to various foreign substances (soil particles, grass, and weeds etc.), maintain a smooth operation under bad weather conditions, easily replace or fix the parts, improve productivity, and decrease the manufacturing cost.

What is claimed is:

1. An automatic golf ball supply device that automatically supplies golf balls to where a user hits the golf balls with a golf club, the automatic golf ball supply device comprising:

a frame having a golf ball outlet at a top;

a vertical carrier having a tee member where the golf ball is held and freely moving up/down to/from the outlet along a guide mounted on the frame;

a motor mounted on the frame;

a first rod having one end connected to a rotary shaft of the motor to pivot forward/backward;

a second rod having a slit at the center portion where the other end of the first rod is fitted, one end hinged to the frame to be pivoted by the first rod, and the other end horizontally moving along a rail formed on one side of the vertical carrier;

a separable pressed-member separated from the vertical carrier when the vertical carrier moves up, and hitting against a pressing plate formed on the other side of the vertical carrier to be pressed when the vertical carrier moves down;

a torque transmitting member connected to the pressed-member and converting the force pressing the pressed-member into torque; and a golf ball guide member pushing the golf ball in the golf ball reservation room to be held on the tee member of the vertical carrier, which has moved down, while being pivoted by the torque transmitting member, wherein the pressed-member includes a bar-shaped structure having one end hit by the pressing plate and the other end being guided up/down along a vertical elongate slit formed at a side face of the frame, wherein the torque transmitting member includes first and second link members pivotally coupled to each other, wherein the first link member having one end coupled to the bar-shaped structure between the both ends thereof and the other end pivotally coupled to one end of the second link member, wherein the other end of the second link member is coupled to a rotation axis of the golf ball guide member in a perpendicular manner.

2. The automatic golf ball supply device according to claim 1, wherein the separable pressed-member includes an elastic roller that hits against the pressing plate of the vertical carrier.

3. An automatic golf ball supply device that automatically supplies golf balls to where a user hits the golf balls with a golf club, the automatic golf ball supply device comprising:

a frame having a golf ball outlet at a top;

a vertical carrier having a tee member where a golf ball is held and freely moving up/down to/from the outlet along a guide mounted on the frame;

a motor mounted on the frame;

a first rod having one end connected to a rotary shaft of the motor to pivot forward/backward;

a second rod having a slit at the center portion where the other end of the first rod is fitted, one end hinged to the frame to be pivoted by the first rod, and the other end horizontally moving along a rail formed on one side of the vertical carrier;

a separable pressed-member separated from the vertical carrier when the vertical carrier moves up, and hitting against a pressing plate formed on the other side of the vertical carrier to be pressed when the vertical carrier moves down;

a torque transmitting member connected to the pressed-member and converting the force pressing the pressed-member into torque; and a golf ball guide member pushing the golf ball in the golf ball reservation room to be held on the tee member of the vertical carrier, which has moved down, while being pivoted by the torque transmitting member, wherein the separable pressed-member includes a rotary member having one end hinged to the frame and the other end equipped with an elastic roller that hits against with the pressing plate of the vertical carrier, and the torque transmitting member includes a driving gear coupled to one end of a rotary lever, a driven gear coupled to a rotary shaft of the golf ball guide member, and an intermediate gear disposed between the driving gear and the driven gear.

4. An automatic golf ball supply device that automatically supplies golf balls to where a user hits the golf balls with a golf club, the automatic golf ball supply device comprising:

a frame having a golf ball outlet at a top;

a vertical carrier having a tee member where the golf ball is held and freely moving up/down to/from the outlet along a guide mounted on the frame;

a motor mounted on the frame;

a first rod having one end connected to a rotary shaft of the motor to pivot forward/backward;

a second rod having a slit at the center portion where the other end of the first rod is fitted, one end hinged to the frame to be pivoted by the first rod, and the other end horizontally moving along a rail formed on one side of the vertical carrier;

a separable pressed-member separated from the vertical carrier;

a torque transmitting member connected to the pressed-member and converting the force pressing the pressed-member into torque; and a golf ball guide member pushing the golf ball in the golf ball reservation room to be held on the tee member of the vertical carrier, which has moved down, while being pivoted by the torque transmitting member, wherein the separable pressed-member includes a pressed-link having a first roller and a second roller that are fitted inside a second rail of the vertical carrier while hitting against a pressing plate of the vertical carrier, and the torque transmitting member includes a protruding hinge arm having one end hinged to the other end of the pressed-link, a locking protrusion that is locked to a preliminary rotary stopper formed at one side of the pressed-link, and the other end positioned on the same rotary axis with the golf ball guide member.

* * * * *